United States Patent [19]

Smith et al.

[11] Patent Number: 4,815,656

[45] Date of Patent: Mar. 28, 1989

[54] RURAL MAIL BOX INDICATOR AND SECURITY LOCK

[76] Inventors: David A. Smith, Thornhurst Star Rte. Box 122, Gouldsboro, Pa. 18424; Robert F. Brown, 7925 Ridge Ave., Abbey La. Unit No. 4, Philadelphia, Pa. 19128

[21] Appl. No.: 143,020

[22] Filed: Jan. 12, 1988

[51] Int. Cl.[4] ..... B65D 91/00

[52] U.S. Cl. ..... 232/34; 232/17

[58] Field of Search ..... 232/35, 34, 17

[56] References Cited

U.S. PATENT DOCUMENTS

| | | | |
|---|---|---|---|
| 833,798 | 10/1906 | Patterson et al. | 232/34 |
| 3,572,581 | 3/1971 | McLeod | 232/35 |
| 3,802,619 | 4/1974 | Vanderveer | 232/35 X |
| 4,113,170 | 9/1978 | Hunsicker | 232/35 |
| 4,190,192 | 2/1980 | Conwell et al. | 232/17 |
| 4,382,540 | 5/1983 | Kelly et al. | 232/17 |
| 4,447,005 | 5/1984 | Kelly et al. | 232/35 |

*Primary Examiner*—Robert W. Gibson, Jr.

[57] ABSTRACT

Disclosed herein is a rural mailbox indicator and security lock including an elongated rod designed to be moved between three positions, a first position indicating that the box is unlocked but no mail is there for pick-up, a second position wherein the box is open and mail is in the box to be picked up and a third position indicating that the box is securely locked against unauthorized entry. The elongated rod is rotatably mounted on a cam which is adjacent a locking mechanism, with the cam having a cut out portion designed to receive a latch of the locking mechanism in the third mentioned position of the elongated rod described above, with the cam further including an arcuate rim designed to interengage with a catch formed on the mail box door so that in the position of the elongated rod corresponding to locked condition, the door is prevented from being opened until the locking mechanism is released by a key.

7 Claims, 1 Drawing Sheet

FIG. 1
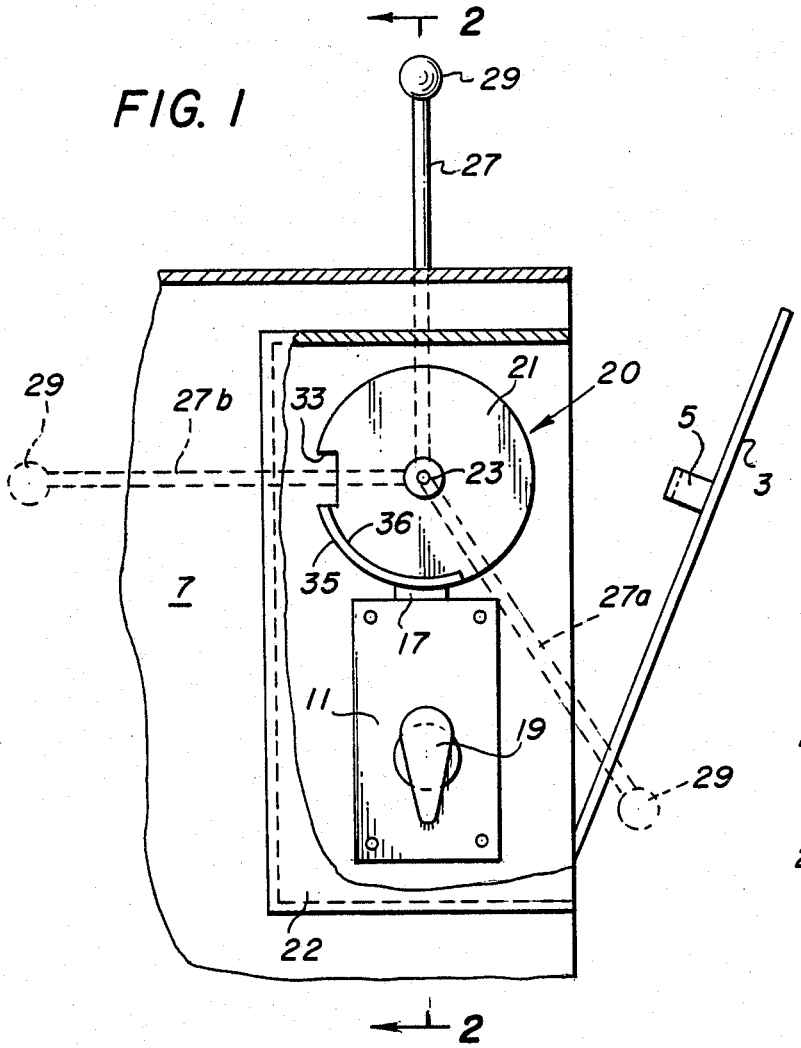
FIG. 2
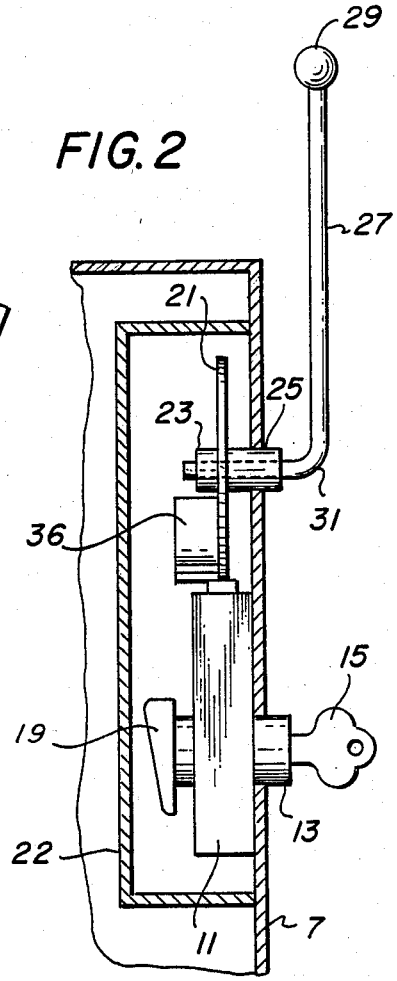
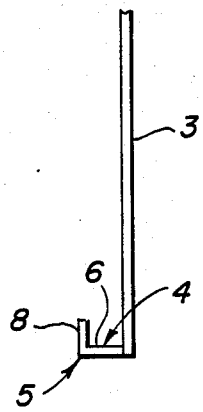
FIG. 3

RURAL MAIL BOX INDICATOR AND SECURITY LOCK

BACKGROUND OF THE INVENTION

The present invention relates to a rural mail box indicator and security lock. In the prior art, locking mechanisms for mail boxes as well as indicator devices therefore are well known. However, applicant is unaware of any such devices which in any way even generally resemble the teachings of the present invention in structure or function.

U.S. Pat. No. 1,128,919 to Utterback discloses a mail box having a locking mechanism for the main door thereof with the main door thereof carrying a smaller door which is freely openable at all times. U.S. Pat. No. 4,382,540 to Kelly, et al. discloses a double-door security rural mail box having a locking mechanism allowing the front closure to be freely opened and closed once by the mail carrier before being secured in a locked position whereupon the front closure may only be unlocked through the use of a key operated lock on the other closure.

As should be self-evident, the teachings of the present invention are only generally related to the teachings of these patents as utilizing a locking mechanism. However, the locking mechanism of the present invention is completely different in structure and function from the teachings of these patents.

SUMMARY OF THE INVENTION

The present invention overcomes the deficiencies found in prior art devices and provides a new and improved rural mail box indicator and security lock which is easy to operate while effectively securing mail in the mail box once placed therein.

The present invention includes the following interrelated aspects and features:

(a) The present invention is intended to be incorporated in a rural-type mail box having an elongated housing with a pivotable door mounted thereon. The pivotable door is provided with a catch on one side thereof having an L-shaped cross-section.

(b) Mounted on a side wall of the mail box adjacent the opening closed by the door is the inventive device including a lock having a reciprocable bolt which is spring loaded in the extended direction and which may be selectively retracted by the insertion of a key in a keyway thereof.

(c) Mounted above the lock on the wall of the mail box is a rotary cam mechanism having an elongated rod attached thereto which comprises an indicator. The cam is disk-like in shape and includes a cut out portion sized and configured to receive the above described bolt in one rotative position thereof so as to prevent further rotations of the cam. The cam further includes an arcuate rim extending outwardly from edge thereof at a right angle to the general plane of the cam, with this rim being designed to engage the catch of the door when the door is in a closed position and the cam is thereafter rotated to the locked position so that in the locked position with the reciprocable bolt entering the cut out portion of the cam, the arcuate rim will engage the catch and prevent the door from being opened until the bolt is retracted by the above described key and the cam is thereafter rotated to a position allowing opening of the door.

Accordingly, it is a first object of the present invention to provide an improved rural mail box indicator and security lock.

It is a further object of the present invention to provide such a device which allows the mail box door to be freely opened and closed and thereafter locked by pivoting of an elongated rod attached to a cam.

It is a yet further object of the present invention to provide such a device including three positions of indication of the elongated rod thereof.

These and other objects, aspects and features of the present invention will be better understood from the following detailed description of the preferred embodiments when read in conjunction with the appended drawing figures.

BRIEF DESCRIPTION OF THE DRAWINGS

FIG. 1 shows a side view of a rural-type mail box with parts thereof broken away to show the inventive device installed thereon.

FIG. 2 shows a cross sectional view along the line 22 of FIG. 1.

FIG. 3 shows a top view of the door illustrated in FIG. 1.

SPECIFIC DESCRIPTION OF THE PREFERRED EMBODIMENT

With reference, firstly, to FIG. 1 it is seen that a rural-type mail box 1 includes a door 3 having a catch 5, with the mail box 1 further including a side wall 7. With reference to FIG. 3, it is seen that the catch 5 includes a first leg 6 extending outwardly substantially normal to the plane of the door 3 and second leg 8 extending substantially normal to the leg 6 and being substantially parallel to the plane of the door 3.

With reference back to FIGS. 1 and 2, it is seen that the inventive security lock 10 includes a lock 11 mounted on the wall 7 within the mail box 1 with the only structure of the lock 11 which protrudes outside the mail box 1 being a cylinder 13 having a keyway (not shown) in which may be selectively inserted a key 15 to facilitate rotation of the cylinder.

As should be understood by the those skilled in the art, the lock 11 is of a well known type wherein rotation of the cylinder results in reciprocation of the bolt 17. As is also well known, the bolt 17 is spring biased in an upward direction in FIGS. 1 and 2 and when the key 15 is not being used to rotate the keyway, the bolt 17 is urged upwardly in FIGS. 1 and 2 responsive to the spring force so that the bolt 17 engages the peripheral surface of cam 21.

As seen in FIG. 1, the lock 11 includes a manual knob 19 which is oriented within the chamber of the mail box 1.

With further reference to FIGS. 1 and 2, the indicator aspect of the present invention is generally designated by the reference numeral 20 and is seen to include a cam 21 of generally disk-like shape mounted on a hub 23, which hub 23 extends through an opening 25 in the wall 7 and is bearingly carried by the hole 25.

Attached to the hub 23 is an elongated rod 27 having, in the preferred embodiment, a ball 29 at its upper end with its lower end being curved at 31 and extending through the hub 23 in mounting relation with respect thereto.

The rod 27 and the cam 21 are rigidly affixed to one another via the hub 23 so that they always move together. The cam 21 has a cut out portion 33 sized and configured to be able to receive the end of the bolt 17 in one rotative position of the cam 21. Furthermore, as best seen in FIG. 2, and arcuate rim 35 is mounted on the cam 21 substantially normal with respect thereto and on a peripheral edge of the cam 21. As should be understood from FIGS. 1 and 2, with the cam 21 and rod 27 in the position shown in FIG. 1, the door 3 may be pivoted to a position wherein it closes the opening in the mail box 1. In such position of the door 3, the catch 5 will extend into the chamber formed by the mail box 1 with the leg 8 thereof extending inwardly of the peripheral edge 24 of the cam 21.

In such position of the door 3, rotation of the elongated rod 27 in the counterclockwise position as seen in FIG. 1 will cause the arcuate rim 35 to rotate along with the cam 21 to a position where the rim will have portions thereof located within a chamber 4 best seen in FIG. 3 to be defined by the door 3 and legs 6, 8 of the catch 5. In such position, the door 3 may not be pivoted to the open position since any movements of the door will be restrained by engagement of the leg 8 of the catch 5 with inner surfaces 36 of the arcuate rim 35.

The preferred embodiment of the invention having been described, its intended operation will now be explained. With particular reference to FIG. 1, when the elongated rod 27 is in the phantom position designated by the reference numeral *27a*, the cut out portion 33 of the cam 21 will be at a rotative position corresponding to approximately one o'clock on a clock face in the view of FIG. 1. In such position, the arcuate rim 35 will be in a position from between about nine o'clock to one o'clock and in such position will not be able to engage the catch 5 of the door 3. In such position, as prearranged the mail carrier will known that there is no mail in the box for pick-up and the door 3 is unlocked.

If mail is to be placed in the box 1 for pick-up, the elongated rod 27 is moved to the full line position shown in FIG. 1 facing directly upwardly. In such position, the cut out 33 of the cam 21 is at the nine o'clock position and the arcuate rim 35 extends between five o'clock and nine o'clock as seen in FIG. 1. In such position, the door 3 may be freely opened and closed since there is no interengagement between the arcuate rim 35 and the catch 5.

After the mailman has opened the door 3 and removed mail from the box 1, as pre-arranged, in order to lock the box 1, the door 3 is first closed and, thereafter, the elongated rod 27 is moved to the phantom designated by the reference numeral *27b* in FIG. 1. In such position, the arcuate rim 35 will extend from two o'clock to six o'clock with the cut out 33 being aligned with the bolt 17 to thereby allow the bolt 17 to enter the cut out 33 and thereby fixably lock the rotative position of the cam 21. In such position, the arcuate rim 35 will enter the chamber 4 seen in FIG. 3 to thereby lock the door 3 against movement.

In this way, mail which has been inserted into the box 1 may be secured against thievery and tampering.

As seen in FIGS. 1 and 2, to prevent mail from tangling up the mechanism of the lock 11 and indicator 20, a housing 22 may be provided which completely encloses the mechanism save for an opening allowing the catch 5 to enter therein so as to enable interengagement with the arcuate rim 35 of the cam 21.

As such, an invention has been disclosed in terms of a preferred embodiment thereof which fulfills each and every one of the objects of the invention as set forth hereinabove. Of course various changes, modifications and other alterations in the teachings of the present invention may be contemplated by those skilled in the art without departing from the intended spirit and scope thereof. As such, it is intended that the present invention only be limited by the terms of the appended claims.

We claim:

1. In a container having a pivotable door closing an opening thereof, the improvement comprising an improved indicator and security lock system including:

(a) locking means including a movable bolt;

(b) indicator means mounted on a rotary disk, said disk rotating in adjacency to said bolt and including a recess alignable in one rotative position of said disk with said bolt;

(c) a catch mounted on said door which extends into said container when said door is in a closed position thereof;

(d) a rim extending outwardly on said disk and adapted to move adjacent said catch to a position preventing movement of said door;

(e) said indicator means extending outside said container for movement with respect thereto, whereby said indicator means and disk may be moved to a first position allowing said door to be freely opened and closed, and said indicator means and disk may be moved to a second position wherein said recess is aligned with said bolt and said rim simultaneously interengages with said catch, said bolt moving in said second position into said recess to lock the rotative position of said disk while simultaneously said interengagement of said rim and catch locks said door against opening.

2. The invention of claim 1, wherein said container comprises a mailbox.

3. The invention of claim 1, wherein said indicator means comprises an elongated rod fixed to said disk, rotation of said rod rotating said disk, said indicator means and disk being rotatable to a third position indicating that nothing is contained within the container, said first position indicating that something is in the container and said second position indicating that the container is locked.

4. The invention of claim 1, wherein said locking means includes a keyway outside said container allowing insertion of a key which, when rotated in said keyway moves said bolt.

5. The invention of claim 1, wherein said catch is of L-shaped configuration defining along with inner surface of said door a chamber, said rim entering said chamber in said second position of said indicator means and disk to lock said door against opening.

6. The invention of claim 5, wherein said rim is substantially perpendicular to said disk.

7. The invention of claim 1, wherein said locking means and disk are contained in a housing mounted in said container, said housing having an opening allowing entry of said catch.

* * * * *